US007475637B2

(12) United States Patent
Rastegar et al.

(10) Patent No.: US 7,475,637 B2
(45) Date of Patent: Jan. 13, 2009

(54) GUN FIRED SENSOR PLATFORMS

(75) Inventors: Jahangir S. Rastegar, 11 Wilderness Path, Stony Brook, NY (US) 11790; Jeffrey Ge, E. Setauket, NY (US); Carlos M. Pereira, Tannersville, PA (US)

(73) Assignee: Jahangir S. Rastegar, Stony Brook, NY (US)

( * ) Notice: Subject to any disclaimer, the term of this patent is extended or adjusted under 35 U.S.C. 154(b) by 34 days.

(21) Appl. No.: 10/888,361

(22) Filed: Jul. 9, 2004

(65) Prior Publication Data

US 2006/0005733 A1 Jan. 12, 2006

(51) Int. Cl.
*F42B 12/36* (2006.01)

(52) U.S. Cl. ..... 102/502; 89/1.11

(58) Field of Classification Search ..... 102/293, 102/502; 361/752, 758, 790, 804; 89/1.11
See application file for complete search history.

(56) References Cited

U.S. PATENT DOCUMENTS 2,856,852 A * 10/1958 Hinman, Jr. et al. ..... 102/214
2,976,806 A * 3/1961 Risk et al. ..... 361/732
3,999,105 A * 12/1976 Archey et al. ..... 361/700
6,892,644 B2 * 5/2005 Rastegar et al. ..... 102/213
6,892,646 B1 * 5/2005 Zimmerman et al. ..... 102/293

OTHER PUBLICATIONS

Voyager I,http://en.wikipedia.org/wiki/Voyager_1, author unkown (retrieved Sep. 10, 2007).*
Apollo 11, Wikipedia the free encyclopedia (http://en.wikipedia.org/wiki/Apollo_11), retrieved Dec. 22, 2007.*
Appolo Lunar Module, (http://en.wikipedia.org/wiki/Apollo_Lunar_Module), retrieved Apr. 20, 2008.*

* cited by examiner

*Primary Examiner*—Troy Chambers
(74) *Attorney, Agent, or Firm*—Scully, Scott, Murphy & Presser, P.C.

(57) ABSTRACT

A projectile for deploying one or more sensors into an area is provided. The projectile includes a sensor platform disposed in the projectile. The sensor platform having: a sensor for detection of a condition within or proximate to the area; a processor and communication device operatively connected to the one or more sensors and to one or more of a remote station and at least one other sensor; and a power source for supplying power to at least the one or more sensors. Methods and apparatus for deploying the one or more sensors into the area are also provided.

9 Claims, 10 Drawing Sheets

GUN FIRED SENSOR PLATFORMS

BACKGROUND OF THE INVENTION

1. Field of the Invention

The present invention relates generally to the deployment of sensors, and more particularly, to gun fired sensor platforms for deploying a plurality of sensors for detecting and tracking objects, including people, within a wide-area.

2. Prior Art

In recent years, numerous sensors and sensory systems have been developed to detect and warn of the presence of chemical and biological agents, intruder detection and tracking and other similar purposes. Many of these sensors have found applications in safety, homeland security and other similar civilian and military areas. For sensors used in applications such as biological and chemical detection to be effectively used in the field, they have to be small and assembled in small packaging. The sensors must also require low power, be capable of remote operation, and must be capable of one or two-way communication with a central station or networked using some wireless technology. These are very challenging tasks and have been an area of very active research and development efforts, which has made a wide range of sensors available.

A challenging task in the development of wireless sensor capability is the development of appropriate means and platforms for their deployment. This is particularly the case for many of the homeland security applications in which the sensors have to be deployed in hazardous or potentially contaminated environments and/or in dangerous locations. For example, consider the situation in which a building or an area is suspected of being contaminated with a deadly chemical or biological agent. In such a situation, the main challenge is to find a safe method for the deployment of the appropriate sensory system without putting personnel at harms way and/or risk the spread of contamination. The option of sending personnel with protective gear is highly risky, can result in the contamination to be spread over larger areas, nearly defeats the efforts of sensor miniaturization and wireless communications, is impractical when armed terrorists are suspected to be present within the building or in the area or when the place is suspected of being booby trapped or is very hard to reach with the cumbersome protective gear. Another option is to employ a robotic device and guide it into position from a safe distance. However, most of the aforementioned issues for sensor delivery by a human are still valid for currently available mobile robotic systems. In addition, mobile robots have to be brought very close to the point of deployment, putting personnel at risk and/or increasing the chances of spreading contaminations, and they cannot climb walls or go into the building through windows or even readily climb stairs or go around hard to maneuver obstacles. In addition, robotic systems developed to date do not possess the intelligence, mobility and agility to be effective for sensor deployment from a safe distance, particularly in a hostile environment. Mobile robots also consume very large amount of power, thereby limiting their range and duration of operation. Direct human and robotic deployment methods also have the disadvantage of eliminating the element of surprise and covert deployment.

A need therefore exists for the development of deployment methods and systems for remote sensors for the detection of chemical and biological agents, remote sensors for the detection of unauthorized intrusion and tracking of intruders or objects such as cars and trucks, and other similar remote sensors. In almost any scenario, it is highly desirable to have the capability of deploying remote sensors and sensor networks from a safe distance, even while out of line of sight of the intended site. In addition, in certain situations, remote sensors may have to be deployed quickly in very hard to reach places such as the ceiling of a warehouse, the side of a building, the side or top of a hill or mountain, high up on trees, and even over a hostile territory. The aforementioned safe distance for deployment may be in tens of meters in certain situations and in kilometers in other situations.

SUMMARY OF THE INVENTION

Therefore it is an object of the present invention to provide gun fired sensor platforms that overcome the disadvantages associated with the prior art.

To address the aforementioned need, a gun-fired wireless sensor platform is provided. The various embodiments of the sensor platform of the present invention disclosed herein can have one or more of the following characteristics:

- The sensor platform can be modular, ready for mounting a wide range of sensors with their appropriate electronics.
- The modular sensor platforms can accommodate a host of sensors of interest for homeland security.
- The platforms will be able to accommodate various power sources and power generation devices.
- The platforms can accommodate various means of one-way and/or two-way wireless communication.
- The sensor platform can provide means for position and orientation adjustment (referred to herein as self-aligning" which is fully described with regard to RF waveguide sensors in co-pending U.S. patent application Ser. No. 10/888,485 the contents of which is incorporated herein by its reference).
- The sensor platforms can be equipped with a certain level of mobility and remote control (gun-fired robotic platforms that could be used as sensor platforms or to perform certain other tasks) to cover relatively large areas following landing.

With such a sensor delivery system, remote and wireless sensors can be delivered from safe distances that could range from tens of meters to tens of kilometers. The sensors may even be delivered from a location that is not directly in the line of site of the intended deployment location or even air dropped. By deploying a number of wireless sensors, a network may be established between the sensors and/or with one or more monitoring stations.

Accordingly, a method for deploying one or more sensors into an area is provided. The method comprising: packaging the one or more sensors into a projectile; loading the projectile into a firing means; and firing the projectile from the firing means into the area.

The packaging can comprise fixing the one or more sensors to a chassis. The packaging can further comprise fixing a processing and communications means and a power source to the chassis to form a sensor platform. The packaging can still further comprise encapsulating one or more of the one or more sensors, processing and communication means, and power source in a potting material. In which case, the method can further comprise filling a gap between a casing of the projectile and the sensor platform with one of a liquid and gel material. Where the one or more sensors are not encapsulated with the potting material the filling can further comprise filling a volume of the sensor platform corresponding to the one or more sensors with the one of the liquid and gel material. In which case, the method can further comprise shedding at least a portion of the projectile casing corresponding to the one or more sensors after the firing to expose the one or more sensors to an ambient environment of the area.

The method can further comprise reducing an impact of the projectile upon landing in the area. The reducing can comprise reducing an impact velocity of the projectile prior to impact in the area. The reducing can also comprise collapsing at least a portion of the projectile that impacts with the area.

Also provided is an apparatus for deploying one or more sensors into an area. The apparatus comprising: a projectile having the one or more sensors disposed therein; and a firing means for firing the projectile into the area.

The one or more sensors can be fixed to a chassis mounted in the projectile. The chassis can further comprise a processing and communications means and a power source fixed thereto to form a sensor platform, each or which being operatively connected to the one or more sensors. The sensor platform can further comprise a potting material for encapsulating one or more of the one or more sensors, processing and communication means, and power source. The projectile can further comprise one of a liquid and gel material disposed in a gap between a casing of the projectile and the sensor platform. Where the one or more sensors are not encapsulated with the potting material the one of a liquid and gel material can be further disposed in a volume of the sensor platform corresponding to the one or more sensors. In which case, the apparatus can further comprise means for shedding at least a portion of the projectile casing corresponding to the one or more sensors after the firing to expose the one or more sensors to an ambient environment of the area.

The apparatus can further comprise means for reducing an impact of the projectile upon landing in the area. The means for reducing can comprise means for reducing an impact velocity of the projectile prior to impact in the area. The means for reducing can also comprise means for collapsing at least a portion of the projectile that impacts with the area.

The firing means can be a gun.

Still further provided is a projectile for deploying one or more sensors into an area. The projectile comprising: a sensor platform disposed in the projectile, the sensor platform comprising: a sensor for detection of a condition within or proximate to the area; a processing and communications means operatively connected to the one or more sensors and to one or more of a remote station and at least one other sensor; and a power source for supplying power to at least the one or more sensors.

The one or more sensors can be fixed to a chassis mounted in the projectile.

The projectile can further comprise a potting material for encapsulating one or more of the sensor, processing and communication means and power source. The projectile can further comprise one of a liquid and gel material disposed in a gap between a casing of the projectile and the sensor platform. Where the sensor is not encapsulated with the potting material the one of a liquid and gel material can be further disposed in a volume of the sensor platform corresponding to the sensor. In which case, the projectile can further comprise means for shedding at least a portion of the projectile casing corresponding to the one or more sensors after the firing to expose the one or more sensors to an ambient environment of the area.

The projectile can further comprise means for reducing an impact of the projectile upon landing in the area. The means for reducing can comprise means for reducing an impact velocity of the projectile prior to impact in the area. The means for reducing can comprise means for collapsing at least a portion of the projectile that impacts with the area.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENT

The present invention discloses a projectile, system, and method for deployment of sensors. Although many types of sensors can be deployed with such projectiles, systems, and methods, one particular type of sensor that has particular utility herein are RE waveguide sensors disclosed in co-pending U.S. patent application Ser. No. 10/888,379 the disclosure of which is incorporated herein in its entirety by its reference.

Figure 1A:
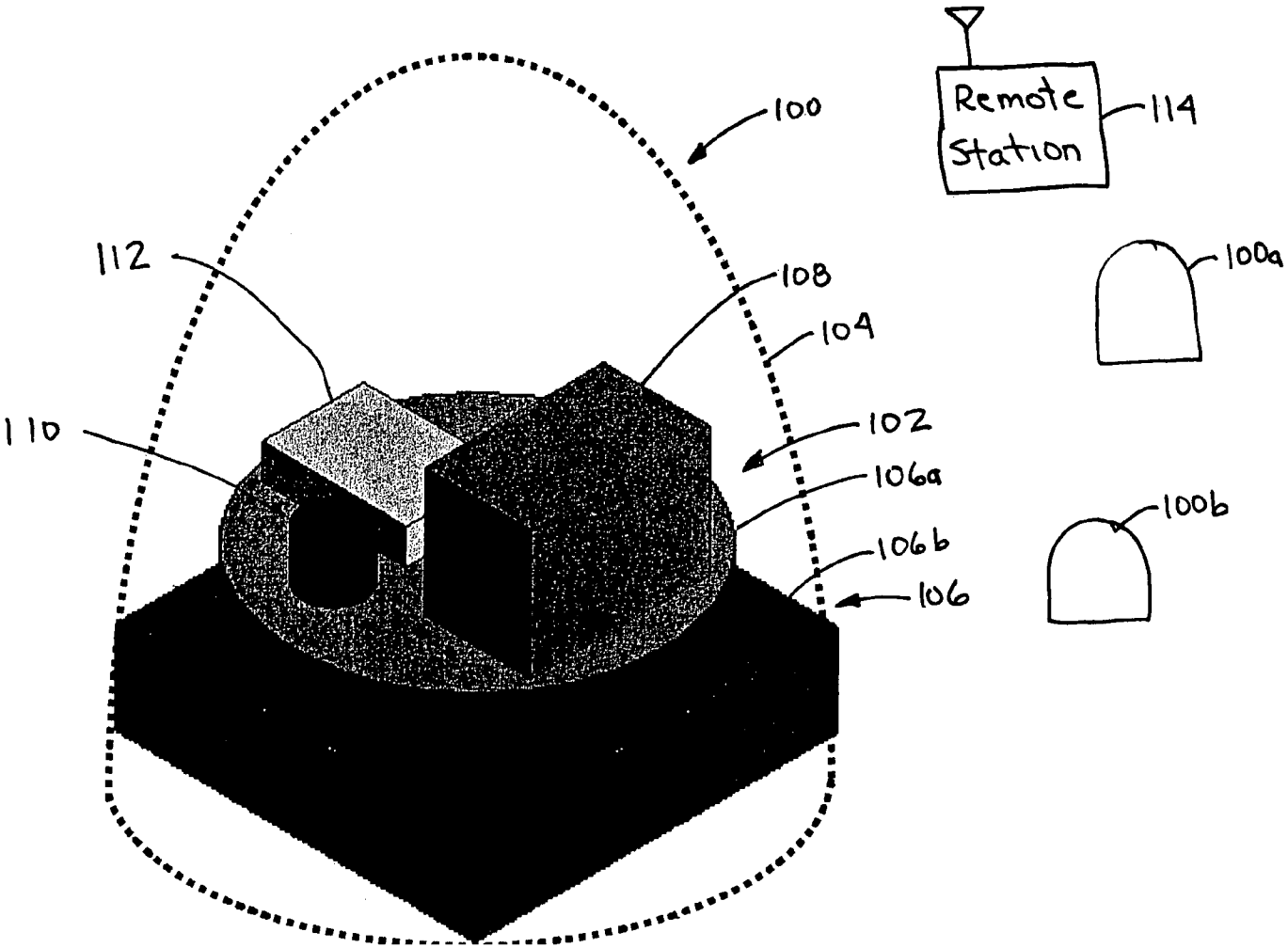
FIG. 1*a* illustrates a first embodiment of a projectile having a sensor platform disposed therein, the projectile being shown in phantom.
Figure 1B:
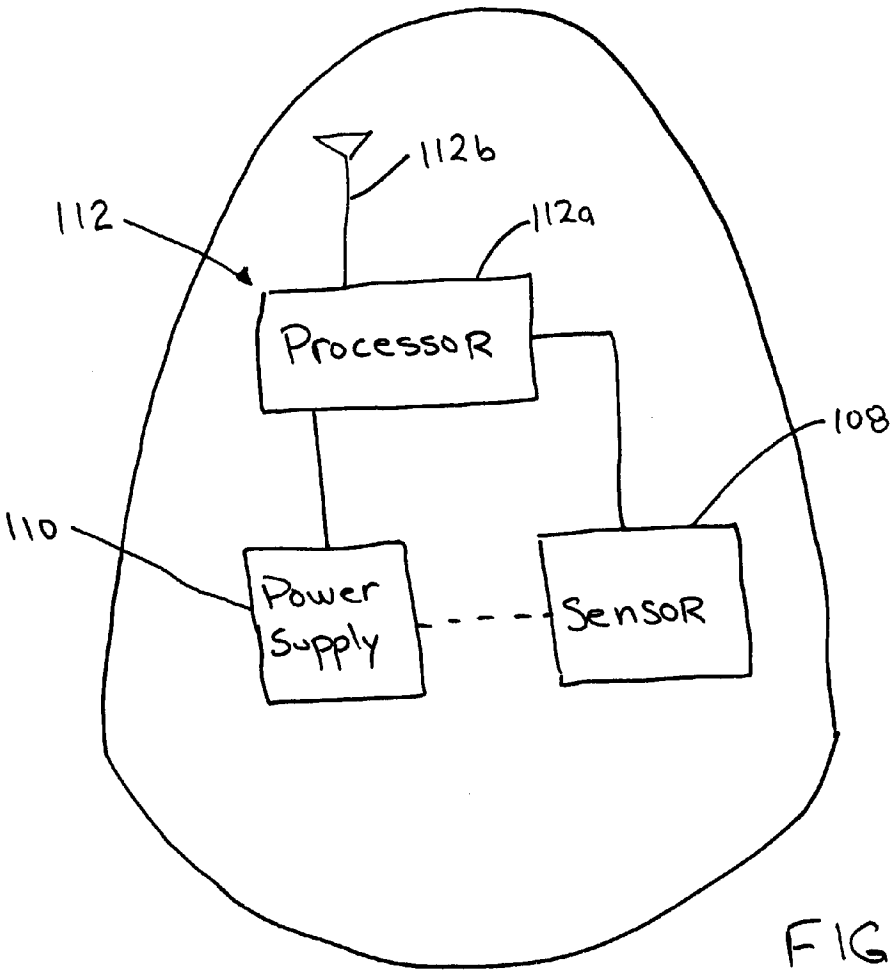
FIG. 1*b* illustrates a schematic representation of the sensor platform of FIG. 1*a*.

Referring now to FIGS. 1*a* and 1*b*, there is illustrated a projectile, generally reference to by reference numeral 100. The projectile 100 includes a sensor platform 102 disposed in a casing 104 of the projectile. The projectile 100 (or a tip section thereof) is shown in FIGS. 1*a* and 1*b* by phantom line. Projectiles and their fabrication and use are well known in the art and the details thereof are not discussed herein for the sake of brevity. Disposing objects within a casing 104 of a projectile 100 are also well know in the art, particularly the munitions arts. Therefore, the sensor platform 102 may be disposed and/or fixed within the projectile 100 in any manner know in the art, such as by fixing the same to a portion of the casing 104 or a frame (not shown) disposed in an interior of the casing 104.

The sensor platform 102 consists of one or more substrates 106 (alternatively referred to herein as a chassis) having the sensor platform components mounted thereon. By way of example, and not to limit the scope or spirit of the present invention, the sensor platform 102 of FIG. 1*a* is shown as having two such substrates 106*a*, 106*b*. The mounting of components on a substrate is well known in the arts, particularly the packaging and semi-conductor chip arts. The sensor platform 102 can include a sensor 108, a power supply 110, and a processing and communications means 112.

The sensor 108 can be of any type known in the art or later developed for detecting a condition in the area in which it is deployed, such as chemical, biological, RF-based intruder detection/tracking, acoustic, visual and the like. The sensor platform 102 must be able to physically fit within the available space inside the projectile 100 and capable of being hardened to withstand firing generated accelerations/decelerations and the landing impact. The sensor 108 can provide its own signal conditioning and other electronics (if any) to generate digital signal(s) to the processing and communication means 112. Alternatively, such signal conditioning and other electronics can be provided in the processing and communication means 112 or they can be separately provided in the sensor platform 102.

One or more of the components of the sensor platform 102 may require a low level of power for their operation. Therefore, a power source 110 can also be provided on the sensor platform 102, which reduces the required space within the projectile 102 for housing a separate power source(s) and extends the operating life of the sensor platform 102. Permanent chemical batteries can be used as the power source 110. However, since the sensor platform 102 will most likely be produced and stored for later use, and since in most cases the life of the power source 110 determines the shelf life, it may be desirable for the power source 110 to have a long shelf life. Since chemical batteries are prone to corrosion and other modes of failure during a long storage time and as a result of firing generated impulsive forces and landing impact, wherever possible, the power source 110 can be a power generator that harvests power from the environment. Such power generators can harvest power from solar energy, light, thermal radiation, acoustic noise, vibration, electromagnetic radiation, and the like. The power generated by power harvesting sources may be stored in rechargeable batteries, capacitors or the combination of the two depending on the power requirements and their maximum rates or used upon generation. Furthermore, the power source 110 may comprise a combination of both permanent batteries and power harvesting sources. The power source 110 can provide power directly to one or more of the components of the sensor platform 102 or through the processor 112*a* or other intermediary device. Furthermore, the sensor platform 102 may eliminate the power source 110 and utilize a general power source (not shown) of the projectile 100 that is used to power other components of the projectile 100, such as a guidance system (not shown).

The processing and communications means 112 of the sensor platform 102 includes a processor 112*a* to process the sensor data and prepare it for transmission to a remote station 114 or to other sensor platforms 100*a*, 100*b* (e.g., other deployed projectiles acting as sensor nodes in a sensor network). The sensor data may also be stored internally in a memory (not shown) on the sensor platform 102. The processing and communication means 112 also includes a communication device such as an antenna or transceiver 112*b* for communicating with the remote station 114, and/or other sensor platforms 100*a*, 100*b* and also in cases in which certain externally received information is to be relayed to the processor 112*a* for appropriate action, such as from the remote station 114 and/or other sensor platforms 110*a*, 100*b*. For example, such externally received information may be used to start and/or stop sensory action, to cease transmission for security reasons, or to repeat transmission of information (which is usually necessary to ensure low power and/or a secure communication link). The processor 112*a* can provide for the level of intelligence that has to be programmed into each sensor 108 and sensor platform 102. Furthermore, the sensor platform 102 may eliminate the processor 112*a* and/or the communication device 112*b* and utilize a general processor and/or communication device (not shown) of the projectile 100 that is used to control other components of the projectile 100, such as the guidance system (not shown) or to communicate with other devices.

Figure 8B:
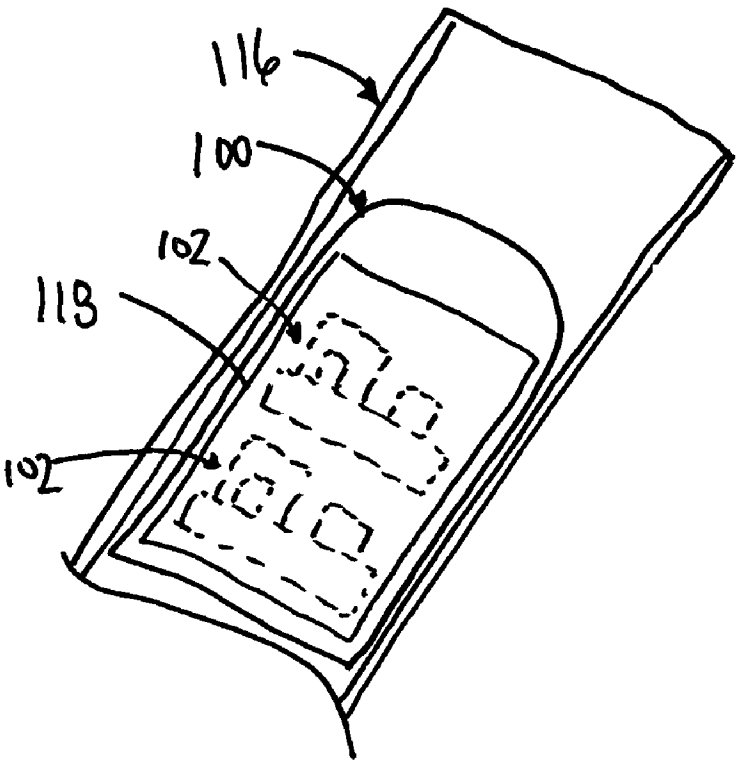
FIG. 8*b* illustrates a canister projectile disposed in a barrel of a gun.
Figure 8A:
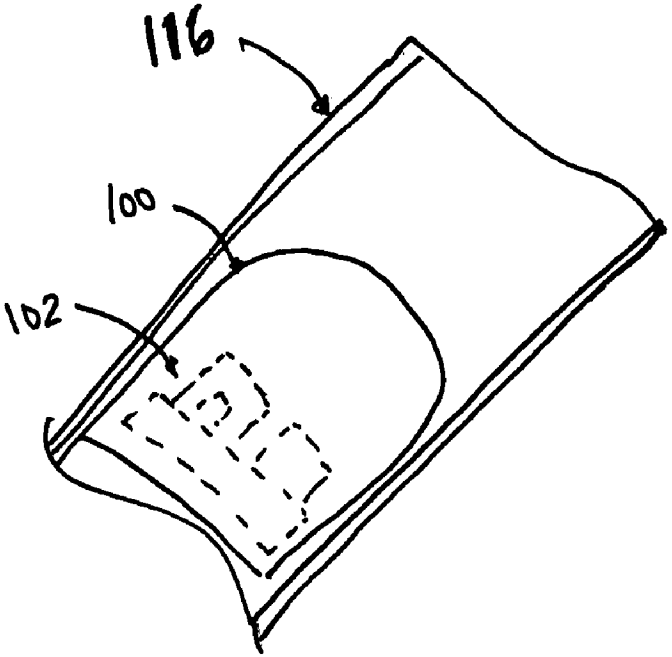
FIG. 8*a* illustrates a projectile having a sensor platform disposed therein disposed in a barrel of a gun.
Figure 8C:
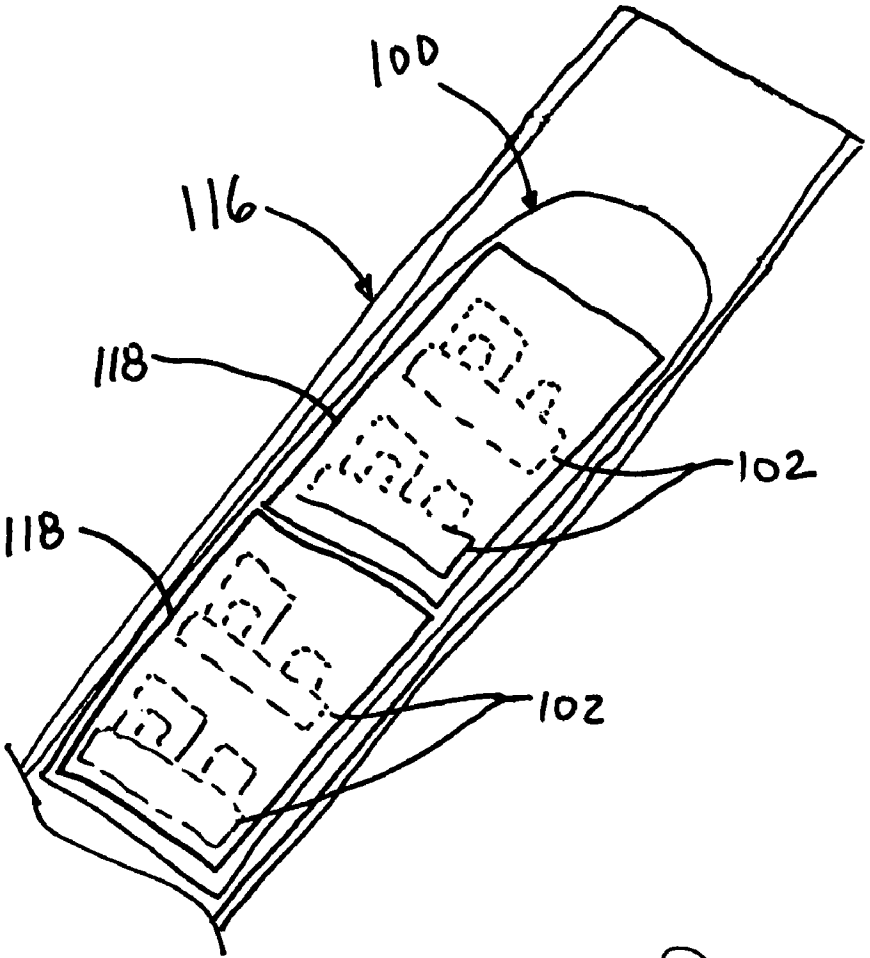
FIG. 8*c* illustrates multiple canister projectiles disposed in a barrel of a gun.

The chassis 106 of the sensor platform 102 is preferably designed in a limited number of shapes and sizes to accommodate various sensor 108, power source 110 and processing and communication 112 modules, and to fit projectiles 100 of various diameters or deployable canisters (See FIGS. 8*b* and 8*c*). Such canisters can be used to pack one or multiple sensor platforms 100 in a single projectile 100 and deploy them in either a predetermined or random pattern along the trajectory of the projectile or as commanded by a command and control station or in response to a sensory input from a sensor mounted on the projectile, such as a sensor that is provided to detect structures, equipment, people or animals, etc. The chassis 106 are also provided with appropriate attachment means such as tapped and untapped holes to accommodate fastening the aforementioned modules thereto and to accommodate fastening the chassis 106 to the projectile casing or other structure (if necessary).

Each chassis 106 is generally designed for the aforementioned three modules 108, 110, 112. However, they may also be equipped with less or more electronics and/or multiple sensors as becomes necessary. In many applications, multiple sensors may be desired to detect multiple threats, detect intrusion and tracking tasks in different directions, and the like.

Figure 5:
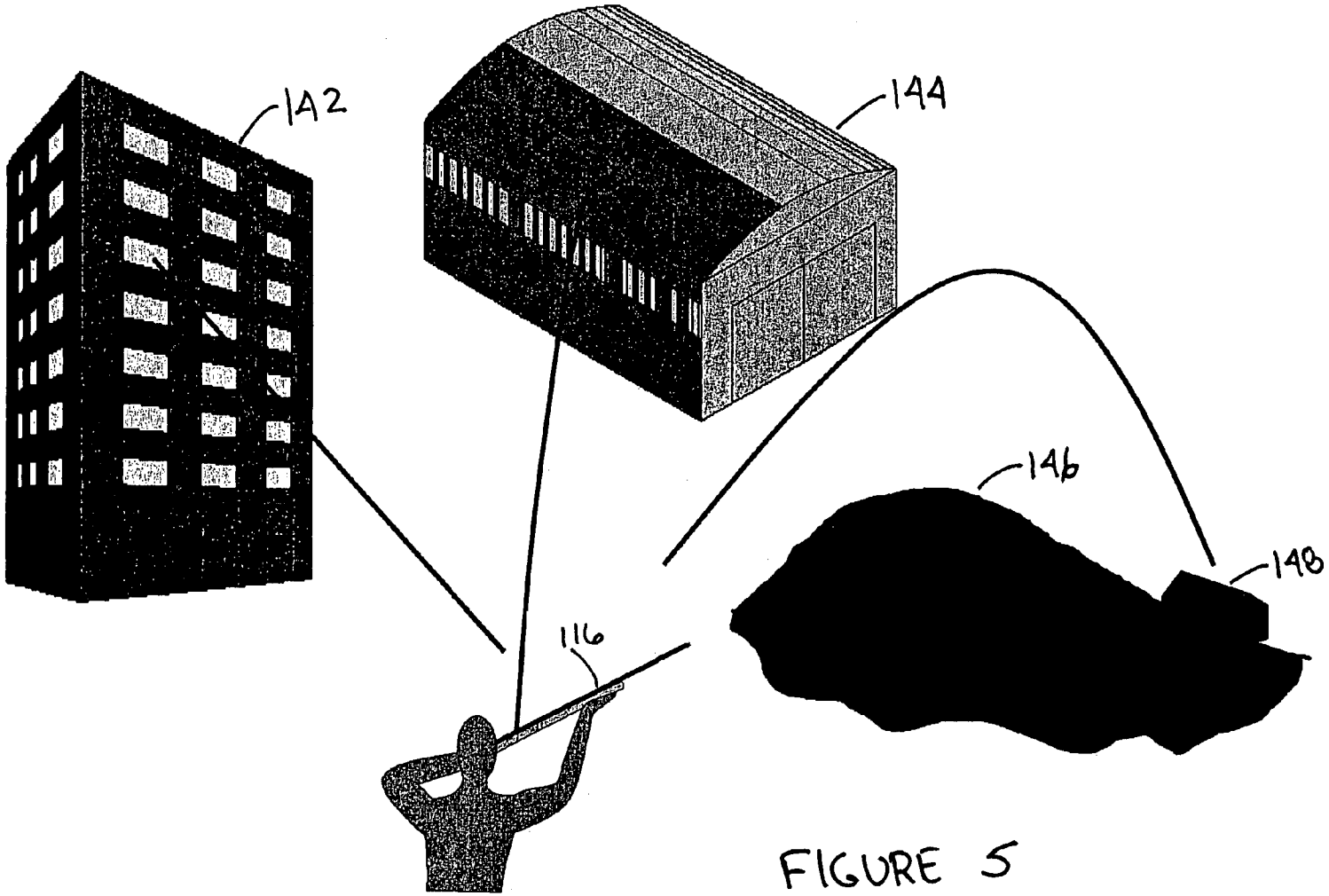
FIG. 5 is a schematic illustration of a gun firing means for firing any of the projectiles disclosed herein into various types of areas.

The sensor platforms 102 can be designed to be scaled to the size of the projectile to be used. The preferred method of launch is a gun 116 as shown in FIG. 5 capable of firing projectiles with diameters of 30-40 mm or larger. In general, larger diameter projectiles are preferred since they provide larger amount of space and for which more generally available components could be used. However, any method of launch is acceptable, including those manually powered, such as bows. As used herein, gun-fired, means all firing means now known or later developed including manually powered devices such as a bow, and powered devices such as rifles, cannons, mortar, rockets, and the like. In certain cases, one or multiple sensor platforms 102 may be packaged inside canisters 118 as shown in FIGS. 8*b* and 8*c*. A number of such canisters 118 may then be packaged inside a projectile 100 and released individually or in groups along the trajectory of the projectile during the flight or dispersed upon or after impact of the projectile. In other cases, one or more sensor platforms 102 may be packaged in a single projectile and deployed and dispersed upon landing.

The level of firing acceleration and deceleration, impact and impulsive forces that are experienced by the projectile 100 and in turn by the gun-launched sensor platform 102 is dependent on the method and means of launch, the level of firing power, and the type of projectile 100. In the case of projectiles fired by a gun, firing accelerations and decelerations of over 10-20,000 Gs are very common. In certain cases, the firing acceleration and deceleration levels experienced by the projectile can be in excess of 50,000 Gs. For this reason, the various modules (108, 110, 112) can be packaged into a sensor platform 102 and then packaged inside the projectile 100 such that all the components could withstand the harsh environment of launch and the impact of landing.

Such shock and impact hardened packaging is known to those skilled in the military and munitions arts. A common practice is to pot all the susceptible components such as sensors and electronics, etc., in epoxy or other similar medium or package them in gel or other soft medium such as polymers to protect them from shock and impulsive forces. In most munitions applications, however, the packaged electronics and other sensitive components do not generally have to be released following landing (or impact on a surface). This may however be the case for certain types of sensors 108, particularly those sensors for detection of chemicals or biological agents. Following landing, the sensor 108 and in some cases the communication means 112*b* should to be exposed into the ambient environment to perform their intended tasks.

Figure 2:
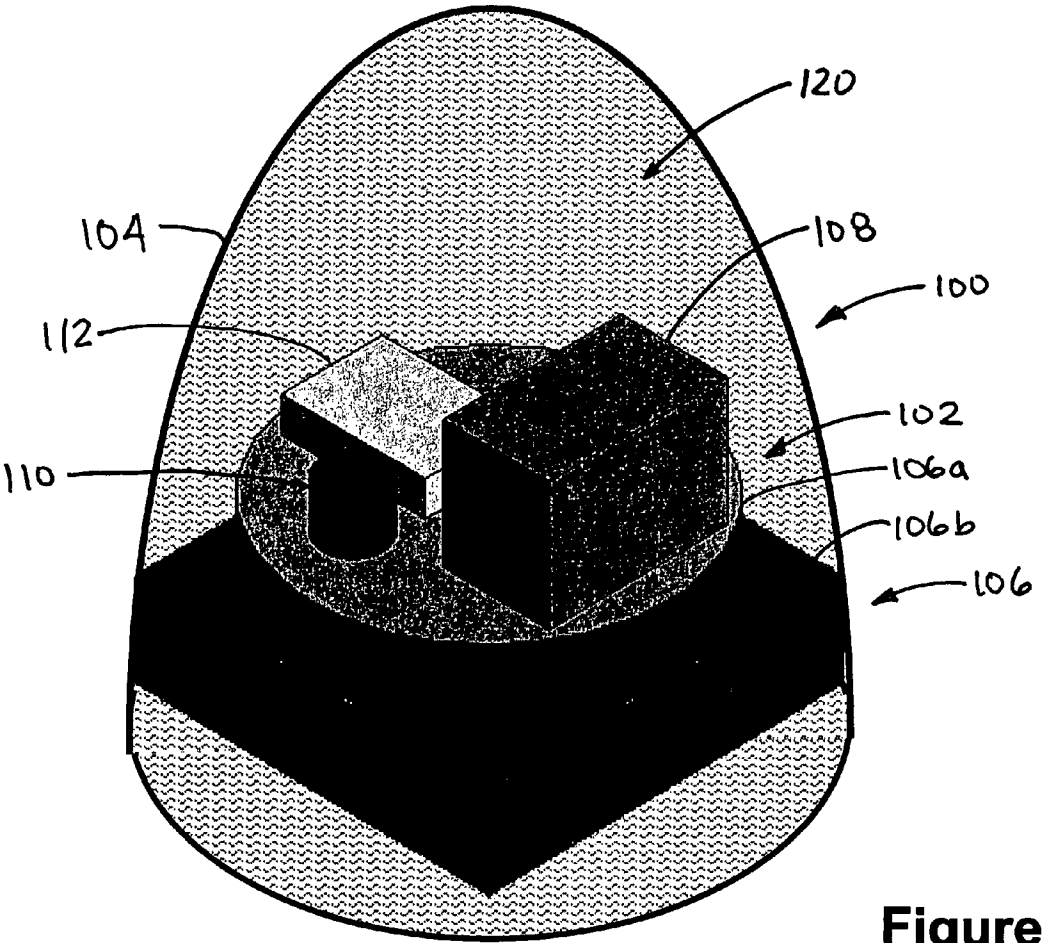
FIG. 2 illustrates a second embodiment of a projectile having a sensor platform disposed therein and a potting material disposed in the casing of the projectile.

Referring now to FIG. 2, the sensor 108, power source 110, and processing and communications 112 modules are first attached to the chassis 106, are wired and tested, and then completely potted in a potting material 120, such as epoxy 120 or other similar type of materials to form them into as unified and rigid a unit as possible. The potted sensor platform 102 is then assembled into the projectile casing 104, and the space between the potted sensor platform and the casing is preferably also filled with similar potting materials 120 as shown in FIG. 2. Care is taken to prevent bubbles to be formed in the potting material 120 to prevent cracking during firing and impact loading. The potting material 120 (polymer or composite) can be transparent to RF signals used for communication and allow the sensor 108 to be in contact with the intended environment to perform its intended tasks. By also constructing the projectile casing 104 with synthetic materials such as plastics and composites, it is possible to transmit RF signals from the processing and communication means 112 and receive RF signals by the same.

Figure 3:
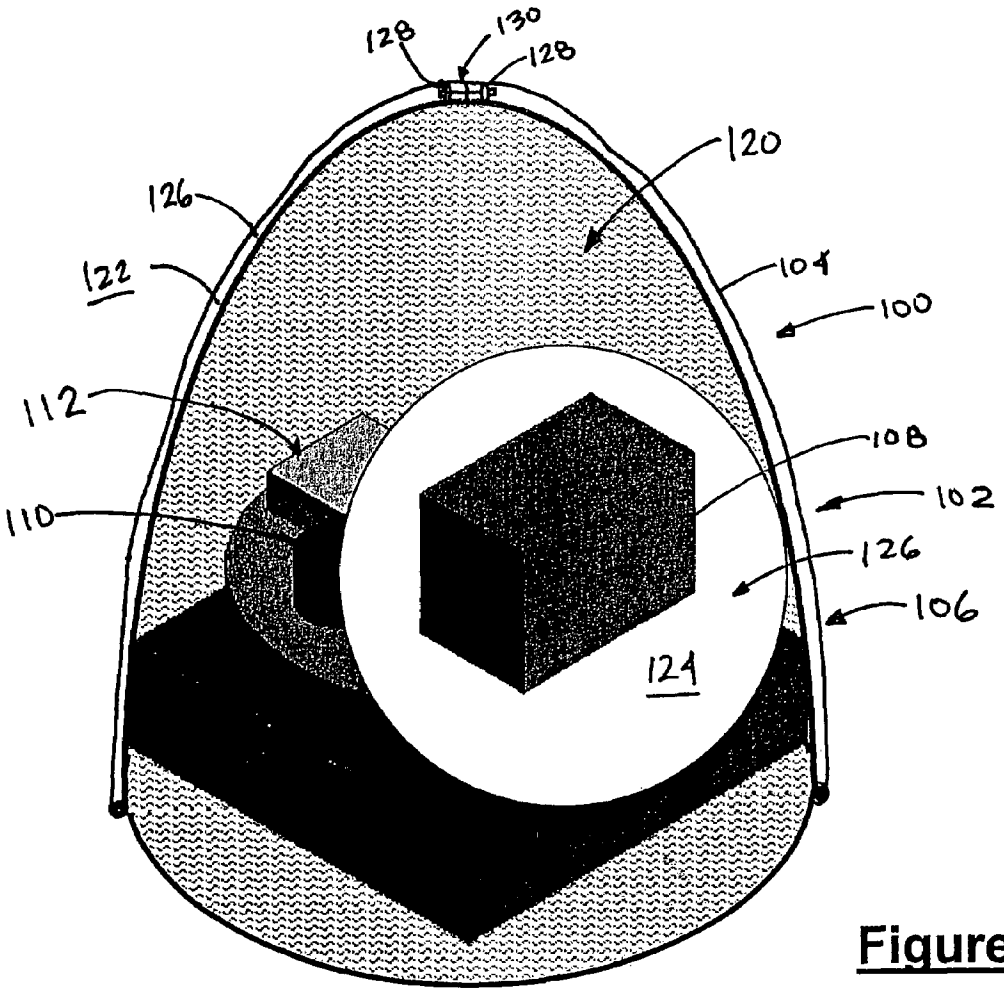
FIG. 3 illustrates a third embodiment of a projectile having a sensor platform disposed therein and a potting material and gel or liquid disposed in the casing of the projectile.
Figure 4:
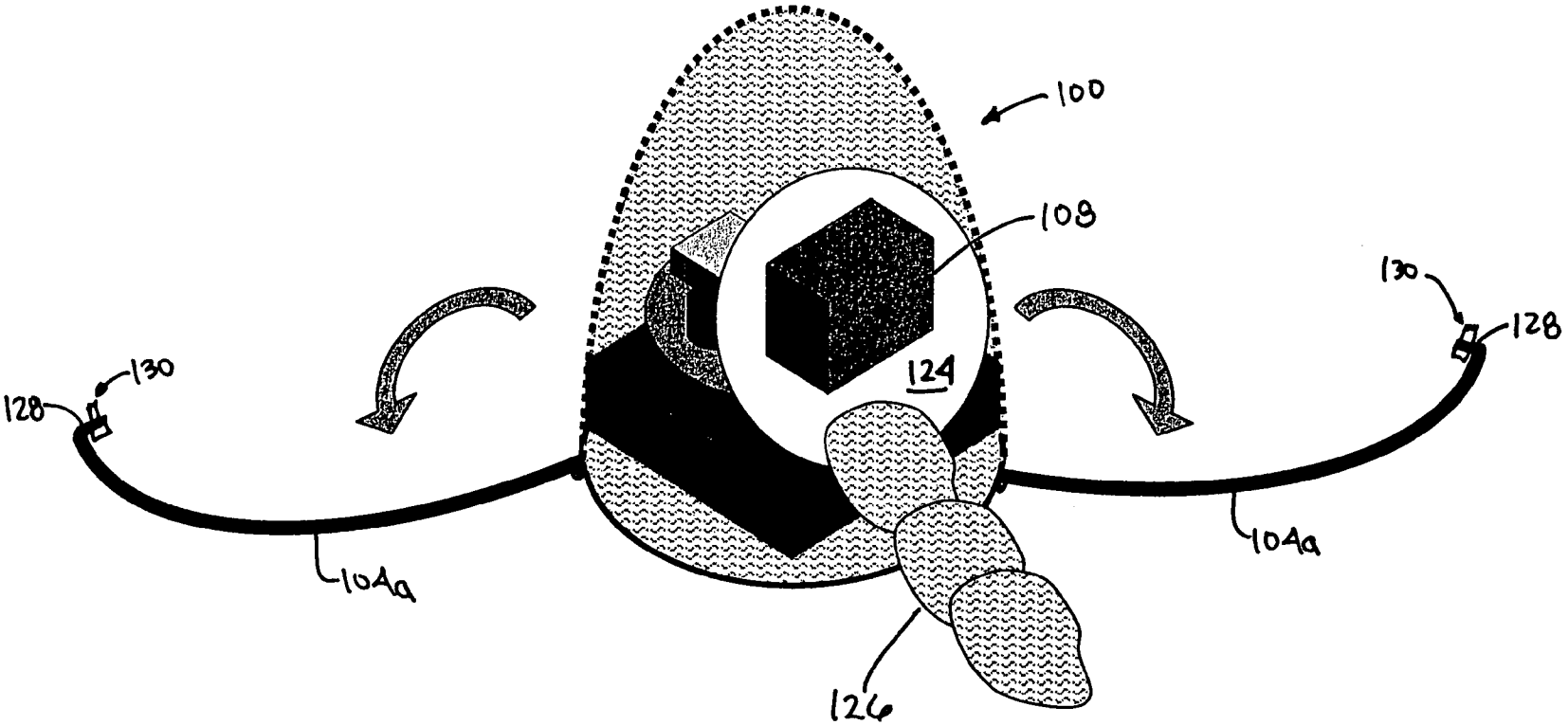
FIG. 4 illustrates the projectile of FIG. 3 after firing and having the casing thereof at least partially removed to expose the sensor platform disposed therein.

The sensor 108, however, may not be capable of performing its tasks within the potting material 120 and/or while within the projectile casing 104. In addition, power sources that harvest solar energy and/or thermal radiation will not be capable of operating if the casing and the potting materials are not transparent to the harvested radiation spectrum. In such cases, other methods of packaging have to be employed. Referring now to FIGS. 3 and 4, the sensor platform 102 and all its components, except the sensor 108 (or a portion thereof that has to be exposed to the environment), are potted in the potting material 120 as previously described, thereby leaving a void 124 in the potting material for a volume corresponding to the sensor 108. The potting material is preferably fairly close to the shape of the interior of the casing 104 but slightly smaller (in the order of 0.1 mm or less, which is preferably filled with a gel or other fluid matter that is dispersed upon exposure). The potted sensor platform 102 is then assembled into the projectile casing 104 and a space 122 between the casing 104 and potted sensor platform 102 and in the void 124 around the sensor 108 is filled with a soft gel or liquid material 126 or other similar easy to flow material. The assembly is preferably performed in vacuum to avoid generating bubbles, which are detrimental to the survival of the sensor platform 102 components during the firing and impact landing.

After firing and either before, during, or after impact, the projectile casing 104 is "shed" as shown in FIG. 4. The projectile casing 104 can have portions thereof 104*a* which are rotatably disposed on the casing 104 which are fastened to each other or to the casing by a flange 128 and releasing means (such as an explosive fastener 130 or a shape memory latching mechanism, each of which is well known in the art). The casing 104 can also have a preloaded spring (not shown) for biasing the portions 104*a* toward an open position. The portions 104*a*, instead of being rotatably disposed on the casing may also be completely removable from the casing using one or more of the releasing means discussed above. Upon shedding of the casing 104 or portions thereof, the gel material 126 is allowed to flow from the void 124 surrounding the sensor 108 and expose the sensor 108 to the ambient environment. Although the casing 104 is shown shedding in FIG. 4, only a small portion of the projectile casing 104 around the sensor module can be shed to expose the sensor 108 to the environment.

For sensor platforms 102 that are equipped with power sources 110 that harvest solar or thermal radiation, potting materials 120 that are transparent to visible and IR lights and are readily available may be used together with a similarly transparent casing. When appropriate, the casing 104 may be provided with a transparent portion (window) (not shown) to allow light and/or IR radiation to enter the interior of the casing.

Referring now to FIGS. 8*a*, 8*b*, and 8*c*, the sensor platform 102 may be individually packaged inside a projectile as shown in FIG. 8*a* and loaded in a gun 116. When the sensor platform 102 has to be deployed out of the projectile casing 104, one or more of the sensor platforms 102 can be packaged inside individual canisters 118 as shown in FIGS. 8*b* and 8*c*. The sensor platforms 102 can be packaged inside the canister 118 as was described above for the projectile casing 104. One or more canisters 118 (FIGS. 8*b* and 8*c*, respectively) are then packaged inside the projectile casing 104 and dispensed as is customarily done for submunitions as is well know in the art, such as that shown in U.S. Pat. Nos. 6,672,220; 6,666,145; 6,659,012; 6,481,666; 5,668,346; 5,616,884; 5,473,988; 5,398,614; 5,363,768; 5,317,975; 5,299,503; 5,287,810; 5,275,101; 5,153,371; 5,140,909; 5,005,481; 5,005,483; 4,858,532; 4,726,297; 4,635,553; 4,565,341; 4,554,871; 4,498,393; 4,444,117; and 4,172,407. Wherever possible, the canisters 118 are preferably deployed prior to the projectile impact to reduce impact loading on the sensor platform and its various modules and to have the sensor platforms 102 with a predetermined orientation. Various methods of dispensing canisters from projectiles providing for controlled landing is also well known in the art as is also shown and described in the above referenced prior art.

Another issue to be addressed is the high impulsive load due to the high acceleration levels that are experienced by the sensor platform 102 during firing. Additionally, similar but significantly lower impact loads may be experienced during landing. Furthermore, since the sensor platform 102 may not have been positioned properly for optimal operation or since some sensors have to be positioned and/or oriented in a certain way to operate properly, the sensor platform 102 may have to provide the means for position and orientation adjustment ("self-aligning") as is disclosed in co-pending U.S. patent application Ser. No. 10/888,485, the disclosure of which is incorporated herein by its reference. In addition, certain wireless sensor platforms 102 may have to be mobile or have certain level of mobility to cover a relatively large area, such as when the sensor platform is deployed from a safe distance inside a warehouse or building or area contaminated with chemical or biological agents or other hazardous materials.

Referring now to FIGS. 6*a*, 6*b*, 7*a*, and 7*b*, several methods are known in the art for reducing impact loads upon landing. One such method is to reduce an impact velocity of the projectile 102 before or upon impact. The main reason for reducing the impact velocity is to achieve a controlled landing. By reducing the impact velocity, the shock loads experienced by the sensor platform 102 and its various components is also reduced. A first method relies on significantly reducing the aft drag. The most common among such methods are deployment of parachutes, rotating wings, and increasing the fin drag at the latter stages of descent. The latter is accomplished by increasing and morphing the fin surfaces such that they would produce extreme levels of drag and turbulence, thereby maximum braking forces.

Figure 6B:
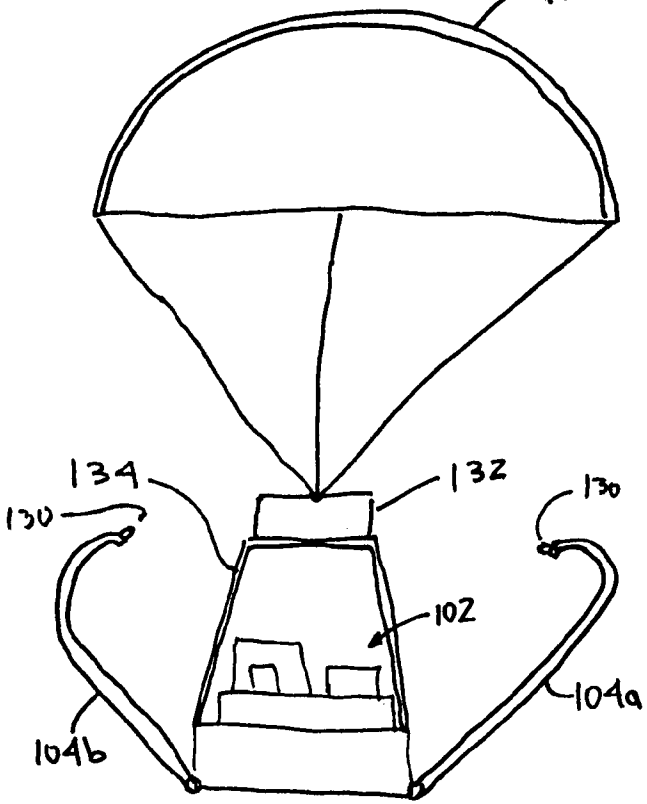
FIG. 6*b* illustrates the projectile of FIG. 6*a* after firing and in which the parachute has been deployed.
Figure 6A:
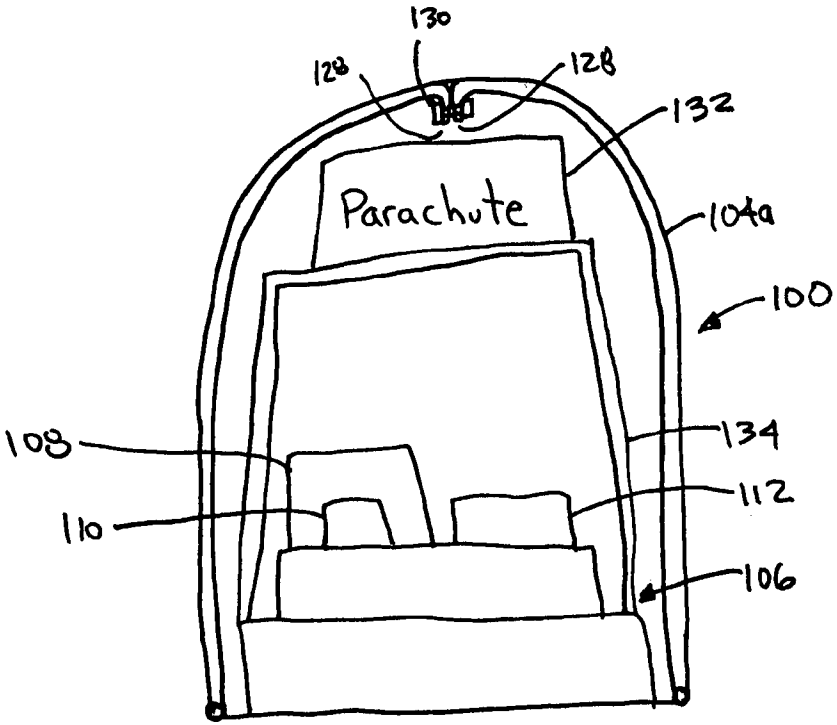
FIG. 6*a* illustrates another embodiment of a projectile having a sensor platform and deployable parachute disposed therein.

FIGS. 6*a* and 6*b* illustrate a projectile 100 having a casing 104 or portion thereof capable of shedding, such as that described above with regard to FIGS. 3 and 4. A deployable parachute 132 is disposed in the projectile 100, such as attached to a frame 134 that is also attached to the chassis 106 and becomes part of the sensor platform 102. Prior to impact, the parachute 132 is exposed and deployed by setting off the charged fastener 130 to shed the casing 104 or portion thereof. The deployed parachute 136 significantly reduces the impact velocity of the sensor platform 102 which may remain with the casing 104 or separate therefrom.

Although the parachute 136 is shown deploying from an aft surface of the projectile 100, those skilled in the art will appreciate that it can also deploy from a rear surface as is known in the art, such as that disclosed in U.S. Pat. No. 5,398,614.

Figure 7B:
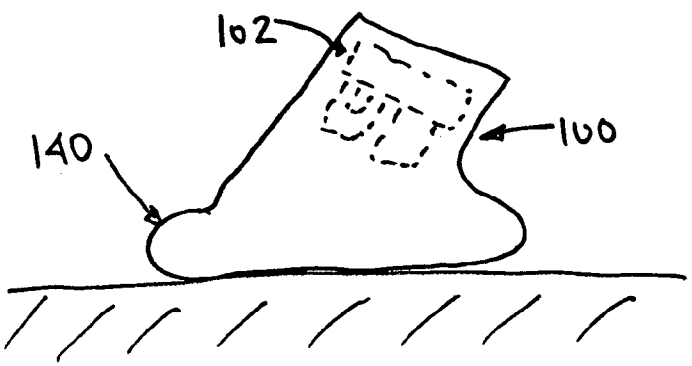
FIG. 7*b* illustrates the projectile of FIG. 7*a* after firing and in which a leading portion of the projectile has collapsed upon impact with a surface within the area.
Figure 7A:
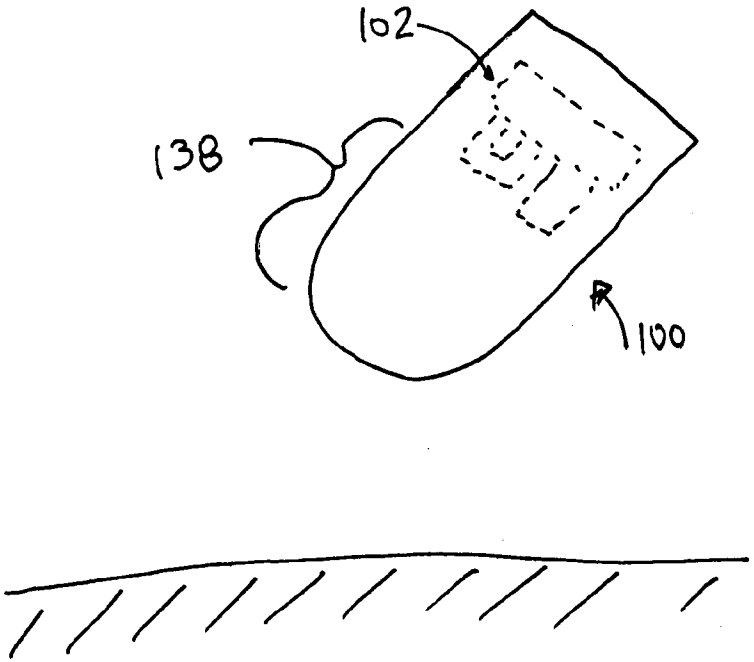
FIG. 7*a* illustrates yet another embodiment of a projectile having a sensor platform disposed therein.

A second method, which can be used alone or together with one of the previous methods, is shown in FIGS. 7*a* and 7*b*. The second method provides for a collapsible front structure 138 of the casing 104 that collapses upon impact in a prescribed manner and thereby deploys the sensor platform with firm footing in a more or less predictable posture. In such a configuration, the sensor platform 102 is positioned and/or oriented in the casing so as not to be damaged by the collapsed portion 140 of the casing 104. The collapsible front section 138 can be fabricated from a material, such as a thin metallic material that easily collapses and/or may have perforations or flexures build in to facilitate its collapse.

The sensor platforms 102 can be designed with a modular chassis 106, within which the sensor 108 and its related components such as the power source 110, electronics, means of position and/or orientation adjustments (if any) are packaged and can be easily changed and interchanged with other types of components. The projectile based sensor delivery systems disclosed herein can be designed to be low cost, easy and safe to use, therefore, they can be made readily available to law-enforcement and emergency personnel. Such gun-fired sensor platforms 102 can be fired behind enemy lines to set up a network of sensors for the detection of personnel and mobile and fixed platforms, the presence of biological and chemical threats, etc., and can also have obvious military and in particular Army applications. As shown in FIG. 5, the sensor platforms 102 can be fired into areas such as a certain room or floor of a building 142, into a warehouse 144, or over a hill 146 such that the target area 148 is out of sight with the firing. Although shown in FIG. 5 as being fired from a hand held gun 116, such is shown by way of example only and not to limit the scope or spirit of the present invention. For example, the firing means may also be shoulder held or attached to a fixed or mobile firing platform.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A method for deploying one or more sensors into an area, the method comprising:

packaging the one or more sensors into a projectile, wherein the packaging further comprises:

encapsulating portions of an interior of the projectile other than a volume corresponding to the one or more sensors to protect the one or more sensors from damage from a firing of the projectile and an impact of the projectile with a surface; and filling the volume with a substantially gel or liquid releasable material;

loading the projectile into one of a gun and mortar;

firing the projectile from the gun or mortar into the area;

allowing the projectile to impact the surface disposed in the area;

exposing the one or more sensors resulting from the impact of the projectile to at least partially release the releasable material from the volume; and detecting a condition in the area after the impact using the exposed one or more sensors.

2. The method of claim 1, wherein the packaging comprises fixing the one or more sensors to a chassis.

3. The method of claim 2, wherein the packaging further comprises fixing a processing and communications means and a power source to the chassis to form a sensor platform.

4. The method of claim 3, wherein the packaging further comprises encapsulating one or more of the one or more sensors, processing and communication means, and power source in a potting material.

5. The method of claim 4, further comprising filling a gap between a casing of the projectile and the sensor platform with one of a liquid and gel material.

6. The method of claim 1, further comprising shedding at least a portion of the projectile casing corresponding to the one or more sensors after the firing to release the releasable material and expose the one or more sensors to an ambient environment of the area.

7. The method of claim 1, further comprising reducing an impact of the projectile upon landing in the area.

8. The method of claim 7, wherein the reducing comprises reducing an impact velocity of the projectile prior to impact in the area.

9. The method of claim 7, wherein the reducing comprises collapsing at least a portion of the projectile that impacts with the area.

* * * * *